United States Patent [19]

Allen

[11] Patent Number: 5,056,428

[45] Date of Patent: Oct. 15, 1991

[54] APPARATUS FOR COMPACTING USED TIRES

[76] Inventor: Lewis E. Allen, P.O. Box 8026, Longview, Tex. 75607

[21] Appl. No.: 660,796

[22] Filed: Feb. 25, 1991

Related U.S. Application Data

[63] Continuation-in-part of Ser. No. 430,865, Oct. 31, 1989, abandoned.

[51] Int. Cl.[5] ..... B30R 15/00

[52] U.S. Cl. ..... 100/200; 100/12; 100/258 R; 100/269 R

[58] Field of Search ..... 100/12, 78, 214, 220, 100/229 R, 245, 258 R, 269 R

[56] References Cited

U.S. PATENT DOCUMENTS

| | | | |
|---|---|---|---|
| 782,862 | 2/1905 | Lucas | 100/214 X |
| 2,822,750 | 2/1958 | Austin et al. | 100/220 |
| 3,955,491 | 5/1976 | McMahon | 100/12 X |
| 3,996,850 | 12/1976 | Whitener | 100/220 |
| 4,006,678 | 2/1977 | Laurie et al. | 100/6 X |
| 4,222,323 | 8/1980 | Martindale | 100/12 |
| 4,413,555 | 11/1983 | Swinney | 100/214 |

FOREIGN PATENT DOCUMENTS

| | | | |
|---|---|---|---|
| 627379 | 9/1961 | Canada | 100/229 R |

*Primary Examiner*—Philip R. Coe
*Assistant Examiner*—Stephen F. Gerrity
*Attorney, Agent, or Firm*—Norman B. Rainer

[57] ABSTRACT

A device for compacting used tires has a rigid base member, a pair of columns rising from the base member, a top beam joining the uppermost extremities of the columns, and a movable engagement member adapted to slide upon the columns. A shaft vertically penetrates the top beam and is pivotally attached to the engagement member. In use, tires are stacked upon the base member, and the shaft, which is essentially a piston component emergent from a pressurized fluid chamber, is caused to force the engagement member downwardly. At the downwardmost point of travel of the engagement member, the tires are tied to form a bale. Retaining assemblies adjustably positioned upon the columns permit tires to be accumulated in multiple pressings prior to baling.

4 Claims, 4 Drawing Sheets

APPARATUS FOR COMPACTING USED TIRES

RELATED APPLICATIONS

This application is a continuation-in-part of U.S. patent application Ser. No. 07/430,865, filed Oct. 31, 1989 (now abandoned).

BACKGROUND OF THE INVENTION

This invention relates to the compaction of tires, and more particularly concerns apparatus for the stacking, compaction and baling of used rubber tires.

Used rubber tires constitute a serious environmental disposal problem. Factories now exist which can dispose of the tires in a manner which derives some value from the tires while not causing adverse ecological consequences. One such manner of disposal involves combustion of the tires under carefully controlled conditions to produce heat which in turn generates electricity.

Because of their relatively large volume and low economic value, careful consideration must be given to the economics of accumulating used tires and transporting them to the processing factory. Whether such transportation is by way of truck or railway car, it is important that the cargo-carrying space be filled as completely as possible.

Methods have earlier been disclosed for compacting rubber tires in stacks, sidewall to sidewall, for more efficient storage and transport. Some of said methods are those employed by tire manufacturers wherein tires of the same size are packaged for more efficient shipment to sales outlets. Said earlier methods of compaction generally employ a hydraulically operated ram terminating in a head plate which presses downwardly upon a stack of tires centered between four vertical posts which guide the head plate. At the lowermost position of the head plate, the tires are bound or baled so that, when the head plate is lifted, the tires can be removed as a compacted and unified stack or bale having considerably less volume than the uncompacted stack.

In the case of randomly accumulated used tires, the tires are of various diameters, widths and thread thickness. The mere stacking of such tires is in itself difficult. When compressive force is applied downwardly onto a stack of randomly sized used tires, uneven resistance to the compressive force, causes tires to move laterally to the direction of compressive force, namely away from stacked alignment. Although the use of four vertical guide posts, as in U.S. Pat. No. 4,006,678, prevents tilting of the head plate due to uneven compressive resistance of the stack, they impede the stacking of the tires and removal of the compacted bales.

A limitation imposed upon earlier compacting devices is the inability to accumulate tires in the bale as a consequence of repeated compression strokes. If, for example a pressing apparatus has a ten foot height capacity and achieves a 5 to 1 compression ratio, a bale of about two foot height is produced, and must be removed prior to subsequent operation of the apparatus. It would be desirable to be able to make large size bales without having to start from a high stack of tires.

It is accordingly an object of the present invention to provide apparatus for the compacting and baling of used tires.

It is further object of this invention to provide apparatus as in the foregoing object adapted to cope with the uneven sizes and compressive characteristics of randomly selected used tires.

It is another object of the present invention to provide apparatus of the aforesaid nature which can be easily and quickly operated.

It is yet another object of the present invention to provide apparatus of the aforesaid nature capable of accumulating tires in repetitive compacting steps to produce bales of varied height.

It is still a further object of this invention to provide apparatus of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a compacting apparatus comprising:

a) a rigid base member, b) a pair of substantially identical columns rising vertically from opposed sites of said base member, and terminating in uppermost extremities, c) a top beam extending in joinder between said uppermost extremities and disposed in substantially parallel relationship to said base member, said beam having an aperture therein centered upon a vertical axis and positioned midway between said columns, d) movable engagement means slidably interactive with said columns and adapted to undergo vertical movement while remaining in substantially parallel juxtaposition to said base member, said engagement means having a lower surface directed toward said base member and an upper surface directed toward said top beam, e) pivot means centered upon the upper surface of said engagement means and aligned with the aperture in said top beam, f) retaining means adjustably disposed upon each column for preventing substantial upward movement of compacted tires disposed upon said base member, and g) a shaft having a lower extremity that engages said pivot means and an upper extremity activated by a cylinder confining a pressurized fluid such as air or liquid, said shaft passing vertically through said aperture.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
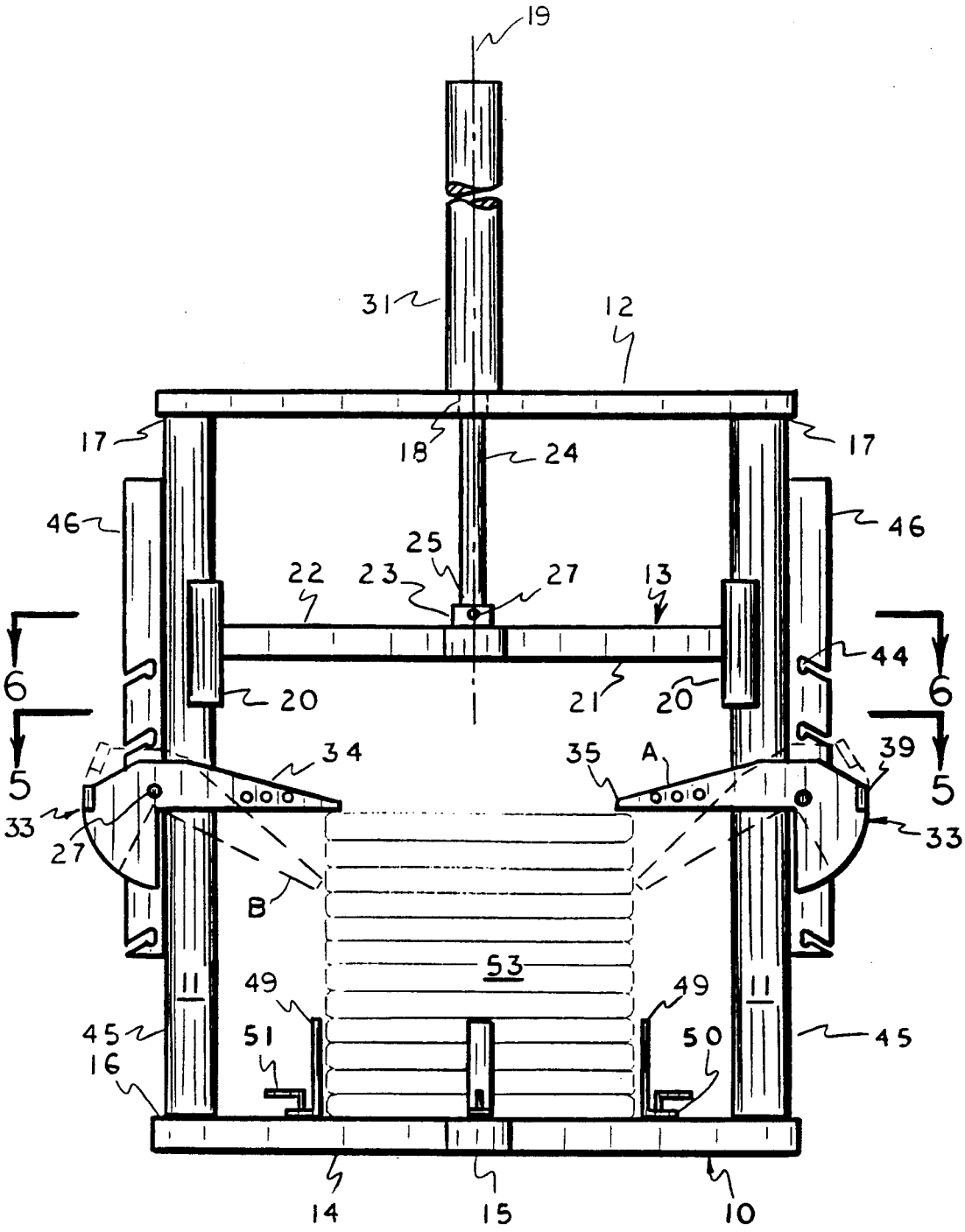
FIG. 1 is a front view of an embodiment of the apparatus of the present invention shown in operational engagement with a stack of tires.
Figure 2:
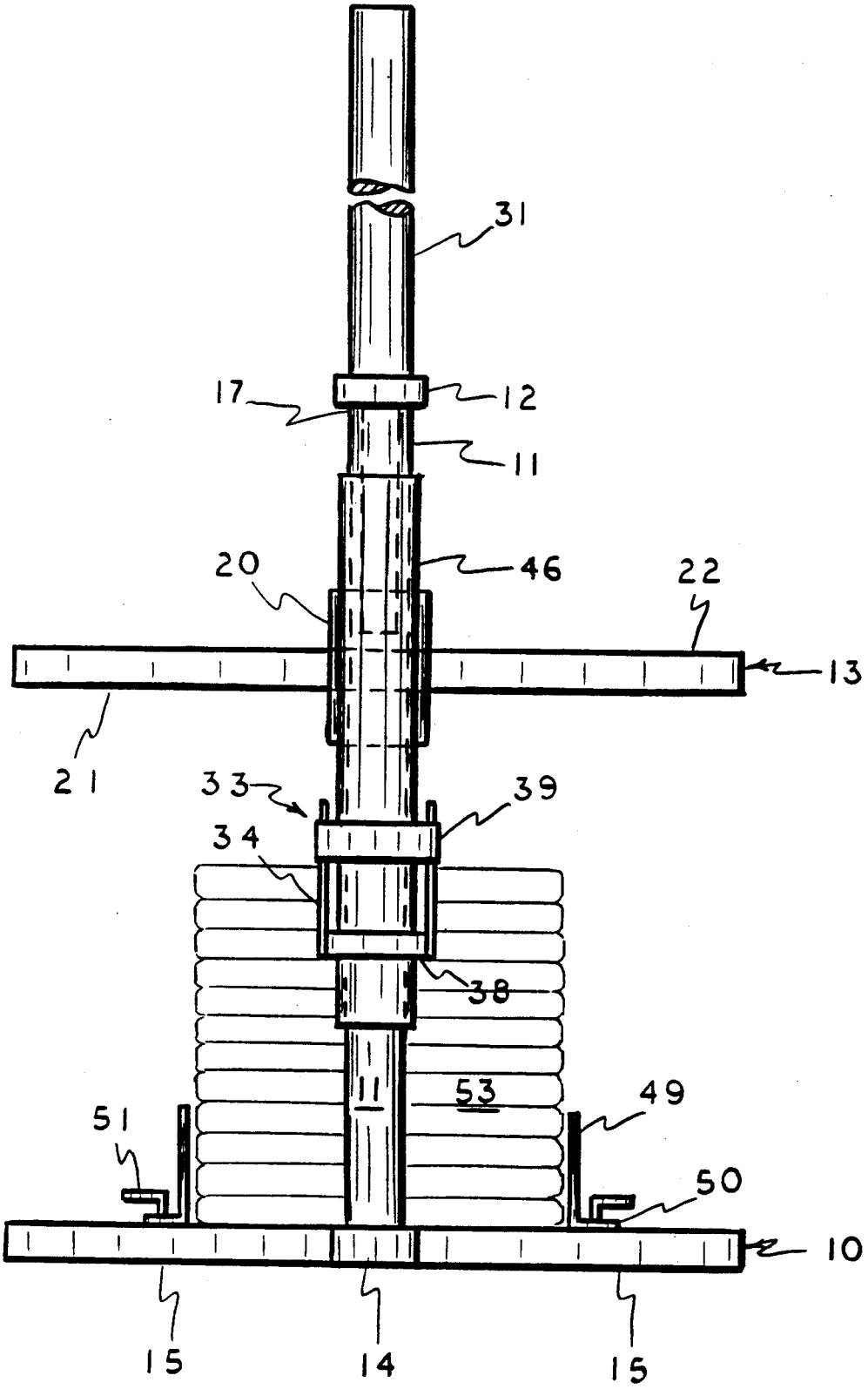
FIG. 2 is a side view of the embodiment of FIG. 1.
Figure 3:
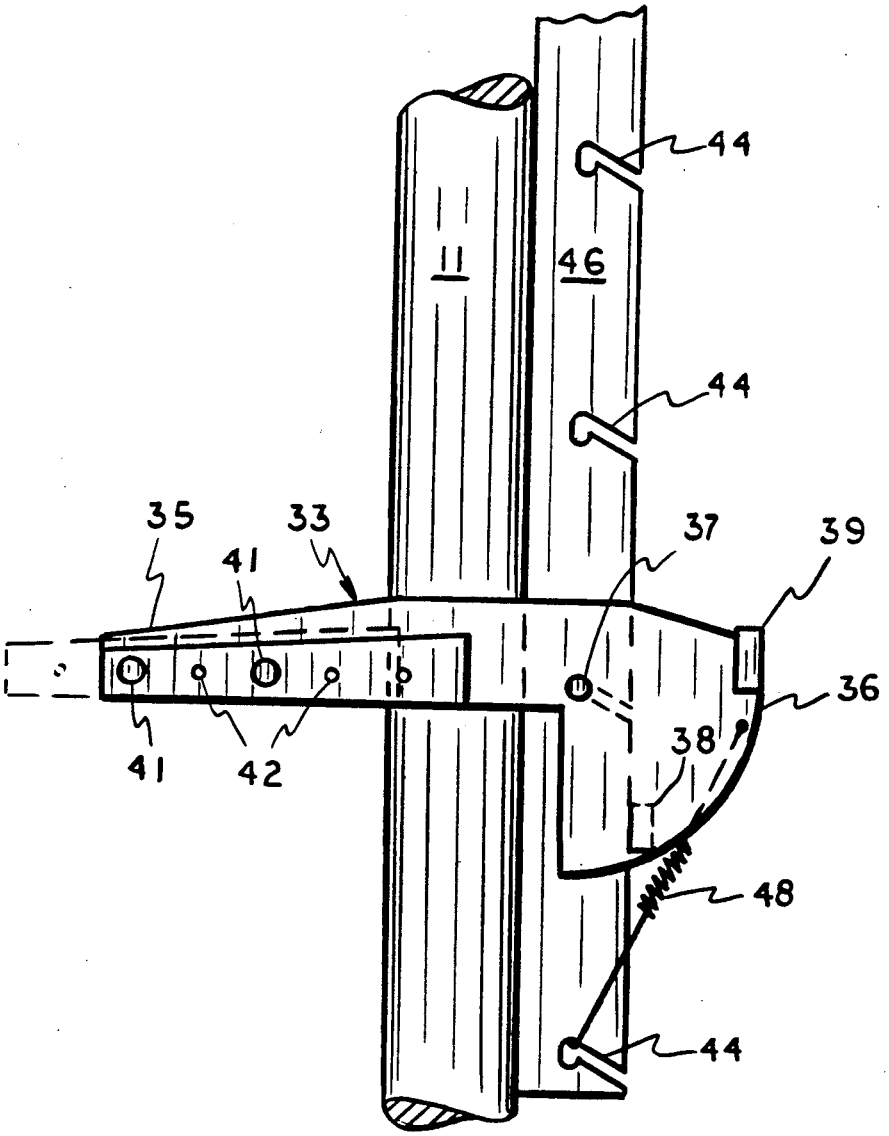
FIG. 3 is an enlarged view of a portion of the apparatus of FIG. 1.
Figure 4:
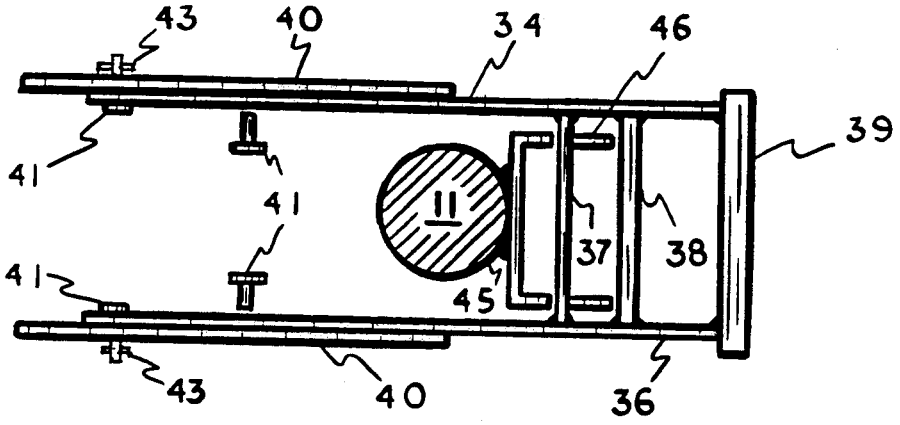
FIG. 4 is a top plan view of the portion shown in FIG. 3.
Figure 5:
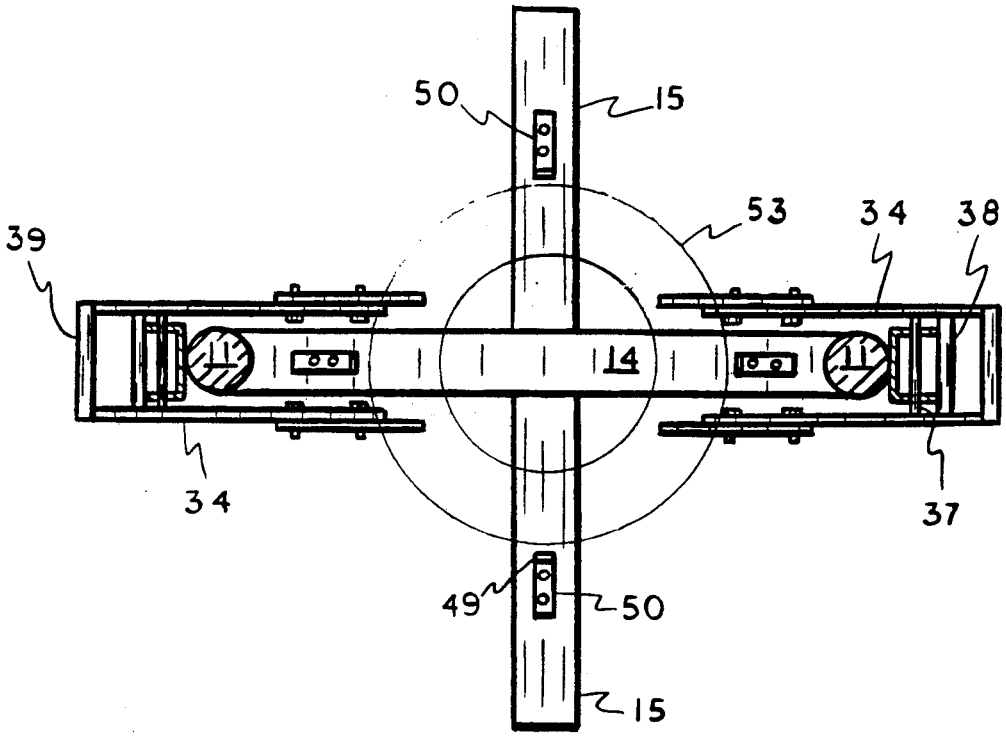
FIG. 5 is a sectional view taken upon the line 5—5 of FIG. 1.
Figure 6:
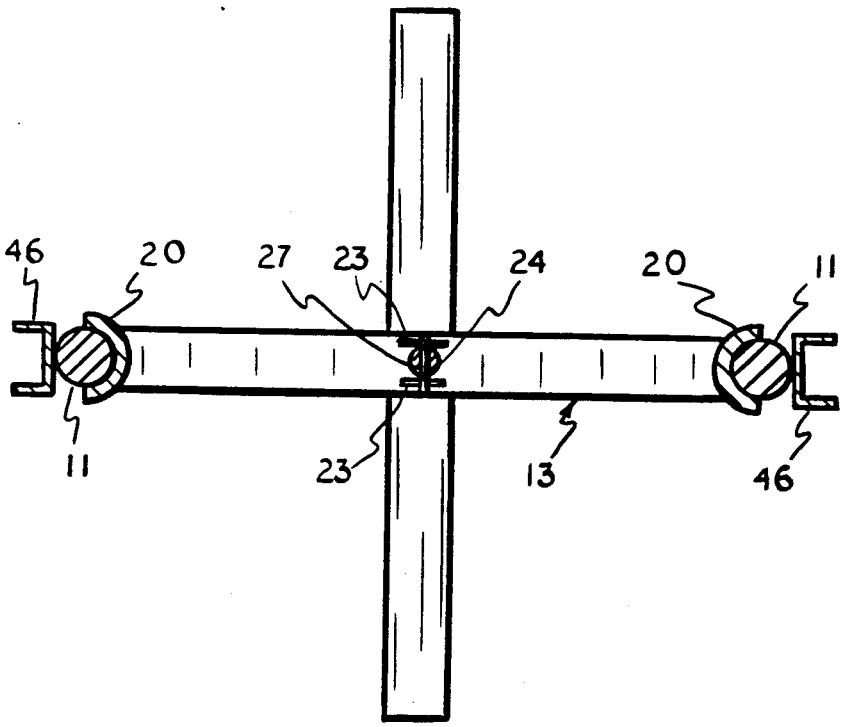
FIG. 6 is a sectional view taken upon the line 6—6 of FIG. 1.

Referring to FIGS. 1-6, an embodiment of the compacting apparatus of the present invention is shown comprised of base member 10 which supports columns 118 top beam 12 joining said columns, and moveable engagement means 13 slidably disposed between said columns and adapted to compact a stack of tires 53.

The exemplified base member 10 is comprised of long beam 14, and short beams 15 welded to long beam 14 at the center thereof and orthogonal thereto, forming an X-shaped coplanar structure possessing four outermost extremities. In other embodiments, however, the base member may have alternative configurations serving equivalent function.

Supporting columns 11, of circular cylindrical contour, are welded to the upper surface 16 of long beam 14 adjacent the outermost extremities thereof. Said columns rise vertically from said base member, and terminate in uppermost extremities 17.

Top beam 12, preferably of iron bar or channel stock, is welded to the uppermost extremities 17 of said columns, disposing said top beam in parallel relationship to base member 10. An aperture 18 is disposed in top beam 12 upon vertical axis 19 and centered midway between said columns.

Movable engagement means 13 is fabricated of steel beams in a manner analogous to the fabrication of base member 10. Lower surface 21 of said engagement means is directed toward said base member, and upper surface 22 faces top beam 12. Guides in the form of semi-cylindrical sleeves 20, are welded to said engagement means 13 at two diametrically opposed sites in a manner whereby said guides 20 slidably engage columns 11.

Paired tabs 23, which may be part of an integral bracket, extend orthogonally upward from upper surface 22 of said engagement means midway between guides 20 and in tangential alignment with aperture 18.

Shaft 24, having lower extremity 25, passes through aperture 18 in centered relationship upon vertical axis 19. Lower extremity 25 is penetratively engaged by pivot pin 27 held by paired tabs 23 and disposed in perpendicular relationship to axis 19 and top beam 12. By virtue of such manner of coupling of shaft 24 with engagement means 13, slight tilting movement is permitted within the plane of the columns. Such slight movement relieves stresses that develop between the guides 20 and their respective columns. Other, equivalent pivot means may be employed to achieve the same effect. The upper extremity of shaft 24 extends into functional engagement with a pneumatic or hydraulic ram cylinder 31 adapted to confine pressurized fluid. In such manner, the shaft acts as a piston which directs force downwardly in response to fluid pressure.

Retaining means 33 are disposed upon each column 11. The exemplified embodiment of said retaining means is comprised of paired arms 34 of plate steel construction that embrace column 11 and extend between interior extremities 35 and exterior extremities 36. Arms 34 are interconnected in spaced apart parallel relationship by fulcrum rod 37, stop plate 38 and counterweight 39, said stop plate and counterweight being associated with exterior extremities 36.

Extension plates 40 are associated with each arm 34 by means of pegs 41 that penetrate holes 42 disposed in aligned sequence in both extension plate 40 and arm 34. Cotter pins 43 may be employed to secure in place each peg 41. Each retaining means 33 is mounted upon each column by said fulcrum rods 37 which are caused to removably engage slotted apertures 44 disposed upon the exterior portion 45 of said column. In the exemplified embodiment, apertures 44 are disposed as a vertically spaced array in a U-shaped channel bar 46 welded to the exterior portion 45 of each column 11.

When properly emplaced, each retaining means will be supported by apertures 44 of corresponding height in each column, and stop plate 38 will lie in abutment with channel bar 46 at a site below fulcrum rod 37. The abutment of stop plate 38 against channel bar 46 is achieved by pivotal movement of the retaining means in a vertical plane about fulcrum rod 37, said pivotal movement being urged by counterweight 39. Such disposition of the retaining means represents a holding position, designated as A in FIG. 1, wherein interior extremities 35 of arms 34 are horizontally disposed, and underlying compacted tires 47 are prevented from rising by abutment with the underside of arms 34. A positioning spring 48 may additionally be employed to achieve the holding position A, said spring extending under tension between the exterior extremity 36 of arm 34 and a slotted aperture 44 below the aperture 44 which engages fulcrum rod 37.

By virtue of the aforesaid construction, retaining means 33 can be displaced to a release position, designated as B in FIG. 1, wherein interior extremities 35 are downwardly directed. In said release position, additional tires can be forced below said retaining means.

Positioning guide bars 49 extending upwardly from base member 10 may be employed to prevent lateral movement of the lowermost tires in the compacted stack. Said guide bars may be radially positionable by way of an apertured foot 50 integral with said guide bar and slidably secured by an apertured track (not shown) recessed within base member 10. A peg 51 may be employed to anchor said foot 50 to a desired aperture within said base member 10.

In use, randomly selected used rubber tires are stacked upon base member 10 while engagement means 13 is in its uppermost position. Both retaining means 33 are placed at equal elevation. Shaft 24 is then caused to move downwardly past said retaining means. At the point of maximum downward movement, the then compacted tires become held in place by said retaining means in their holding positions A. The compacted tires are securely tied together to form a unitary bale. Wires, ropes, chains or other strong tying materials may be utilized. The downward pressure is then released from the shaft, and the consequently released bale is removed from the apparatus. The volume of the bale is 50% to 80% smaller than the volume of the uncompacted tires, depending upon the nature of the tires.

If it is desired to create a bale of greater height, shaft 24 is raised without the baling or removal of the previously compacted tires, and additional tires are stacked upon the earlier compacted tires now held by said retaining means. The shaft is again urged downwardly, forcing the newly added tires past the retaining means, and adding them to the previously compacted tires. Baling can then be done, or even further sequential additions can be made to the stack of compacted tires before baling.

The apparatus of this invention can handle tires of various types and sizes such as tires for passenger vehicles, trucks, aircraft, and military, construction and farm vehicles. The apparatus may be constructed in different sizes to accommodate tires of different assorted sizes.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Apparatus for compacting used tires comprising:

a) a rigid base member, b) a pair of substantially identical columns rising vertically from opposed sites on said base member, and terminating in uppermost extremities, c) a top beam extending in joinder between said uppermost extremities and disposed in substantially parallel relationship to said base member, said beam having an aperture therein centered upon a vertical axis positioned midway between said columns, d) movable engagement means slidably interactive with said columns and adapted to undergo vertical movement while remaining in substantially parallel juxtaposition to said base member, said engagement means having a lower surface directed toward said base member and an upper surface directed toward said top beam, e) pivot means centered upon the upper surface of said engagement means and aligned with the aperture in said top beam, f) retaining means adjustably positionable at different elevations upon said column for permitting downward movement of tires being compacted while preventing substantial upward movement of compacted tires disposed upon said base member, and g) a shaft having a lower extremity that engages said pivot means, and an upper extremity activated by a cylinder confining a pressurized fluid, said shaft passing vertically through said aperture.

2. The apparatus of claim 1 wherein said retaining means are comprised of paired arms held in parallel juxtaposition by a fulcrum rod.

3. The apparatus of claim 2 wherein said retaining means are associated with said columns by said fulcrum rods in a manner permitting pivotal movement of said paired arms in vertical planes about said fulcrum rods.

4. The apparatus of claim 3 wherein said paired arms can be adjustably elongated toward said vertical axis.

* * * * *